US005289769A

United States Patent [19]

Lewis

[11] Patent Number: 5,289,769

[45] Date of Patent: Mar. 1, 1994

[54] METHOD AND APPARATUS FOR CHANGING A PRINTING SLEEVE

[75] Inventor: Robert J. Lewis, Carlisle, Pa.

[73] Assignee: W. O. Hickok Mfg., Co., Harrisburg, Pa.

[21] Appl. No.: 930,774

[22] Filed: Aug. 17, 1992

[51] Int. Cl.[5] ..... B41F 27/00

[52] U.S. Cl. ..... 101/218; 101/375; 101/483

[58] Field of Search ..... 101/212, 216, 375, 378, 101/376, 415.1, 382.1, 483, 218

[56] References Cited

U.S. PATENT DOCUMENTS

| | | | |
|---|---|---|---|
| 1,329,325 | 1/1920 | Mascord | 101/216 |
| 4,119,032 | 0/1978 | Hollis | 101/216 |
| 4,144,812 | 0/1979 | Julian | 101/368 |
| 4,144,813 | 0/1979 | Julian | 101/375 |
| 4,697,516 | 10/1987 | Rombout | 101/216 |
| 4,823,693 | 4/1989 | Kobler | 101/375 |
| 4,966,076 | 10/1990 | John | 101/216 |
| 5,042,788 | 0/1991 | Bowman et al. | 270/8 |
| 5,101,726 | 4/1992 | Lubke et al. | 101/216 |

*Primary Examiner*—Edgar S. Burr
*Assistant Examiner*—Ren Yan
*Attorney, Agent, or Firm*—Harris Beach & Wilcox

[57] ABSTRACT

A system for changing a removable sleeve on a printing roller in a flexographic printing press is disclosed. Axially fixed bearing assemblies are installed on the mandrel of the printing roll, and positioned in a split bearing block. In changing the printing sleeve, at least one bearing block is opened to release the bearing assemblies as the mandrel is raised and fitted with a removable axial extension. The axial extension is then braced to support the roll in a raised position. The printing sleeve can then be axially extracted onto the extension, clearing the printing roller and the frame of the printing press. A second brace is then applied intermediate the printing roller and the extracted printing sleeve. Withdrawal of the first brace allows the printing sleeve to be entirely removed while the partially dismounted printing roller is stabilized by the second brace. A replacement printing sleeve is then placed over the axial extension, and the process reversed.

12 Claims, 6 Drawing Sheets

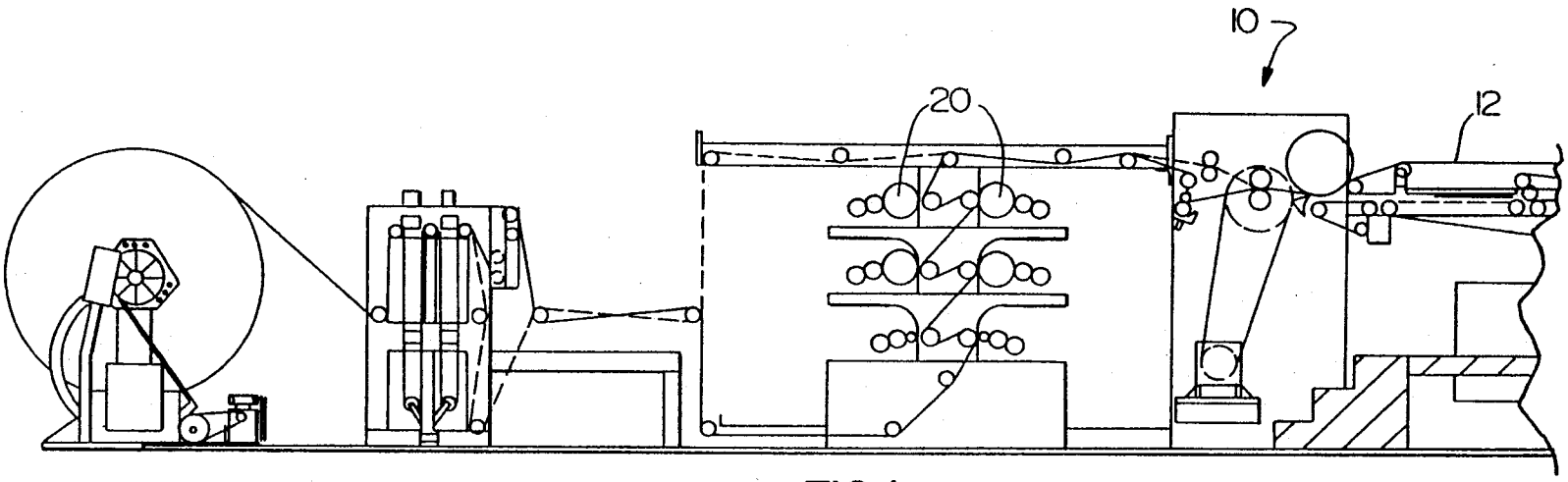
FIG. I
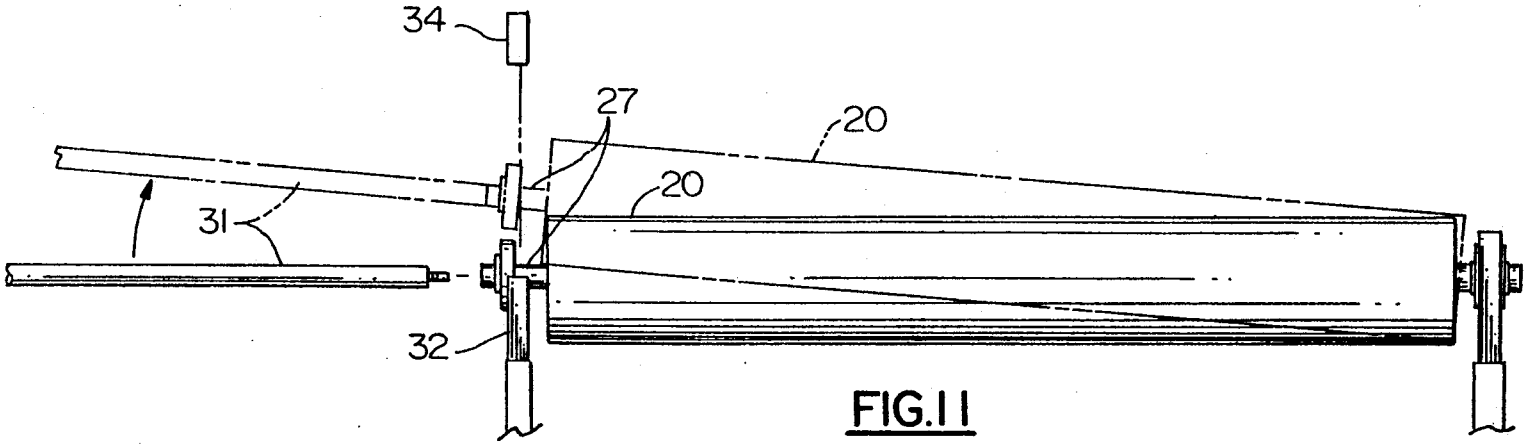
FIG. II

METHOD AND APPARATUS FOR CHANGING A PRINTING SLEEVE

BACKGROUND OF THE INVENTION

1. Field of the Invention

This invention relates to a printing press of the type having a removable printing sleeve on a printing roll. Such presses are typically used for flexographic printing.

2. Description of the Prior Art

Demountable printing sleeves are now common in the art of flexographic printing, and a variety of techniques for fitting and demounting such sleeves on printing rolls are known. A typical modern printing sleeve is disclosed in Julian, U.S. Pat. No. 4,144,812.

While the art of moving a printing sleeve on and off a printing roll is well developed, the need to manipulate the printing roll itself during the exchange continues to present a serious bottleneck in the operation of flexographic printing presses. In most printing presses the entire printing roll has to be removed from the printing machine, and then replaced after the printing sleeve is changed. This is tedious, labor intensive, and results in a high level of unproductive time for the printing press.

In Hollis, U.S. Pat. No. 4,119,032, it is shown that a printing sleeve can be removed from a printing roll while the roll remains substantially in its working position. In the Hollis apparatus, the printing roll rides in a bearing block assembly, the entire assembly being axially removable from the mandrel of the roll. During the interval when the roll is deprived of the bearing block's support, it is maintained in position by a counterpoise that bears downward on the opposite end of the roll mandrel. Once the bearing block is removed, the printing sleeve can be slid off the roll and replaced.

Removal of bearings from the shaft of a printing rolls is difficult, particularly if the bearing is press-fitted onto the shaft. The use of set screws to prevent the bearing block from axially sliding on the shaft is likely to score the shaft, which can make subsequent removal of the bearing even more difficult. The scoring can shorten the useful life of the printing roll, and necessitate expensive re-milling in order to restore it to operating condition. Alternatively the bearing could be freely slidable on the shaft. The latter approach is used in the above noted Hollis patent; however it requires complex adjustable axial restraints to maintain the bearing in proper alignment during operation.

SUMMARY OF THE INVENTION

It is therefore a primary object of the present invention to provide an improved system for replacing a printing sleeve without removing the printing roll of a printing press.

It is another object of the present invention to provide an improved apparatus for changing a printing sleeve with the printing roll in situ and without removing the bearings from the roll.

These and other objects of the present invention are attained by in a printing machine of the type having a demountable printing sleeve on a printing roll. The printing roll has a bearing assembly disposed on a coaxial shaft or mandrel. The bearing assembly is held in an openable bearing block during operation of the printing machine. When it is desired to change the printing sleeve, the bearing block is opened, which permits the shaft and the bearing assembly to be displaced together from the bearing block in a substantially radial direction. An axial extension is then inserted into the displaced end of the mandrel, and a removable support brace is positioned on the extension at an interval from the end of the printing roll sufficient to allow the printing sleeve to clear the printing roll and side frame of the machine. The sleeve can then be axially extracted from the roll and moved over the extension. A second support brace is then placed intermediate the now sleeveless roll and the extracted sleeve. The first brace is then withdrawn, allowing the sleeve to be completely removed from the extension. A replacement sleeve can then be mounted by a reversal of the bracing procedure, and the roll remounted in the bearing block.

BRIEF DESCRIPTION OF THE DRAWINGS

For a better understanding of these and other objects of the present invention, reference is made to the detailed description of the invention which is to be read in conjunction with the following drawings, wherein:

FIG. 1 is a diagrammatic side view of a flexographic printing press showing a printing roll in an operating position;

FIGS. 7–11 show steps in the process of removing a printing sleeve.

DESCRIPTION OF THE PREFERRED EMBODIMENT

Figure 2:
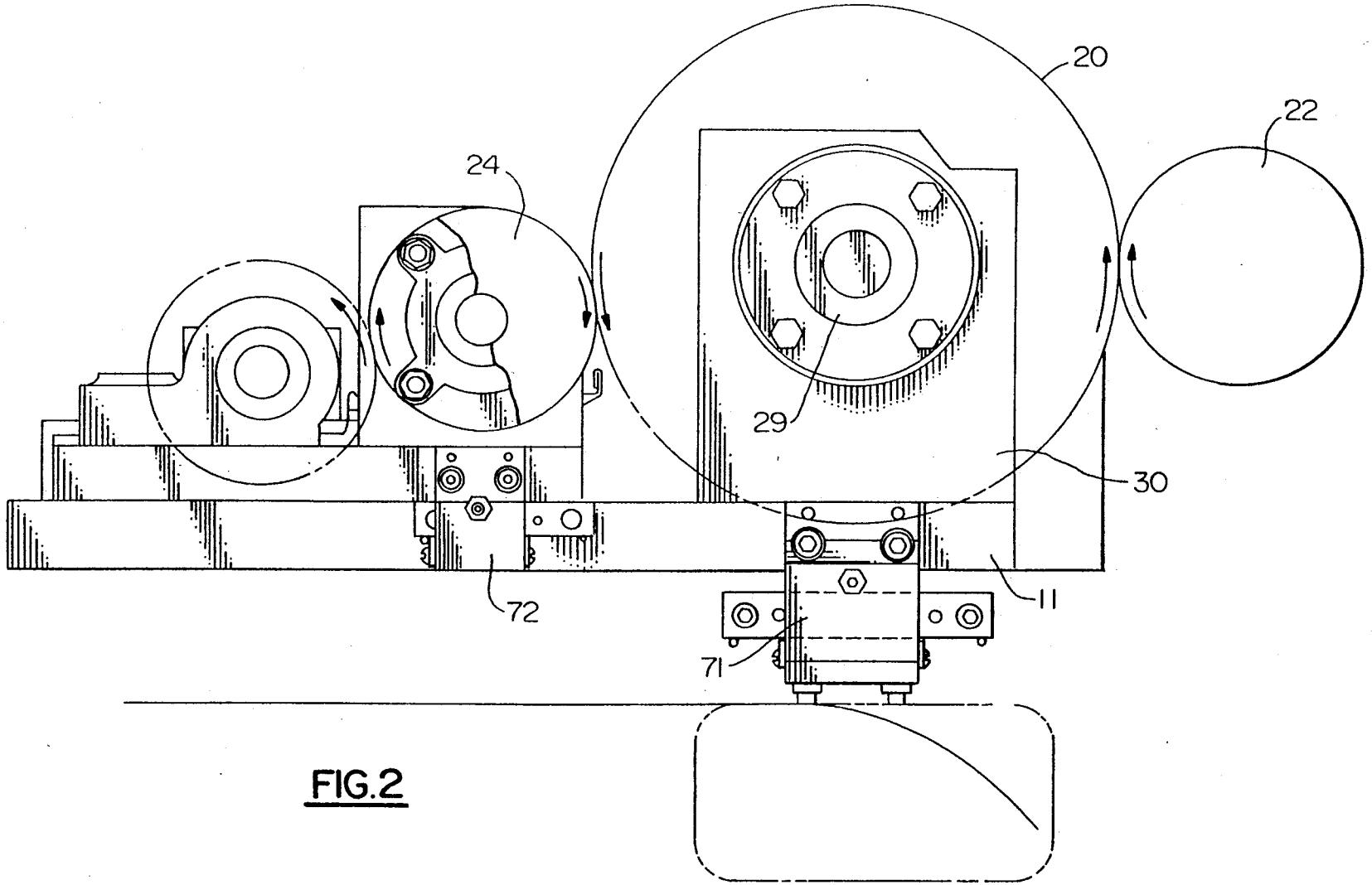
FIG. 2 is a partially diagrammatic side elevation of a printing roll in accordance with the invention.
Figure 3:
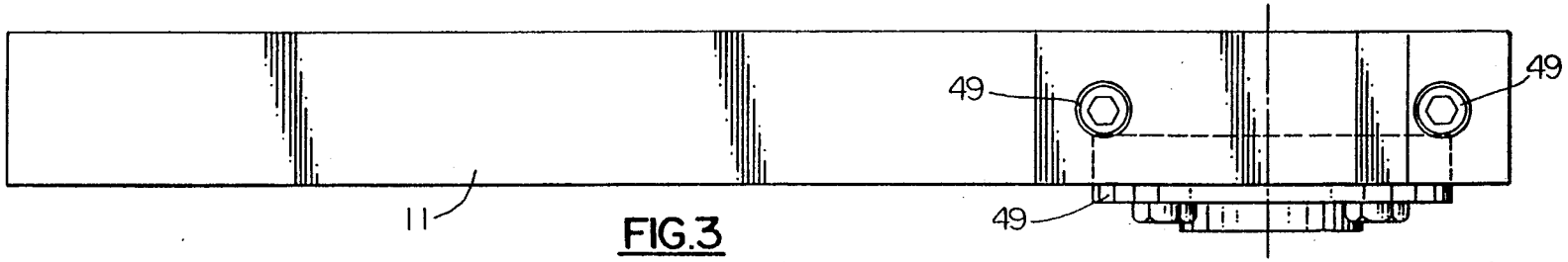
FIG. 3 is an elevation of an end of the printing roll of FIG. 2 and its bearing block.
Figure 4:
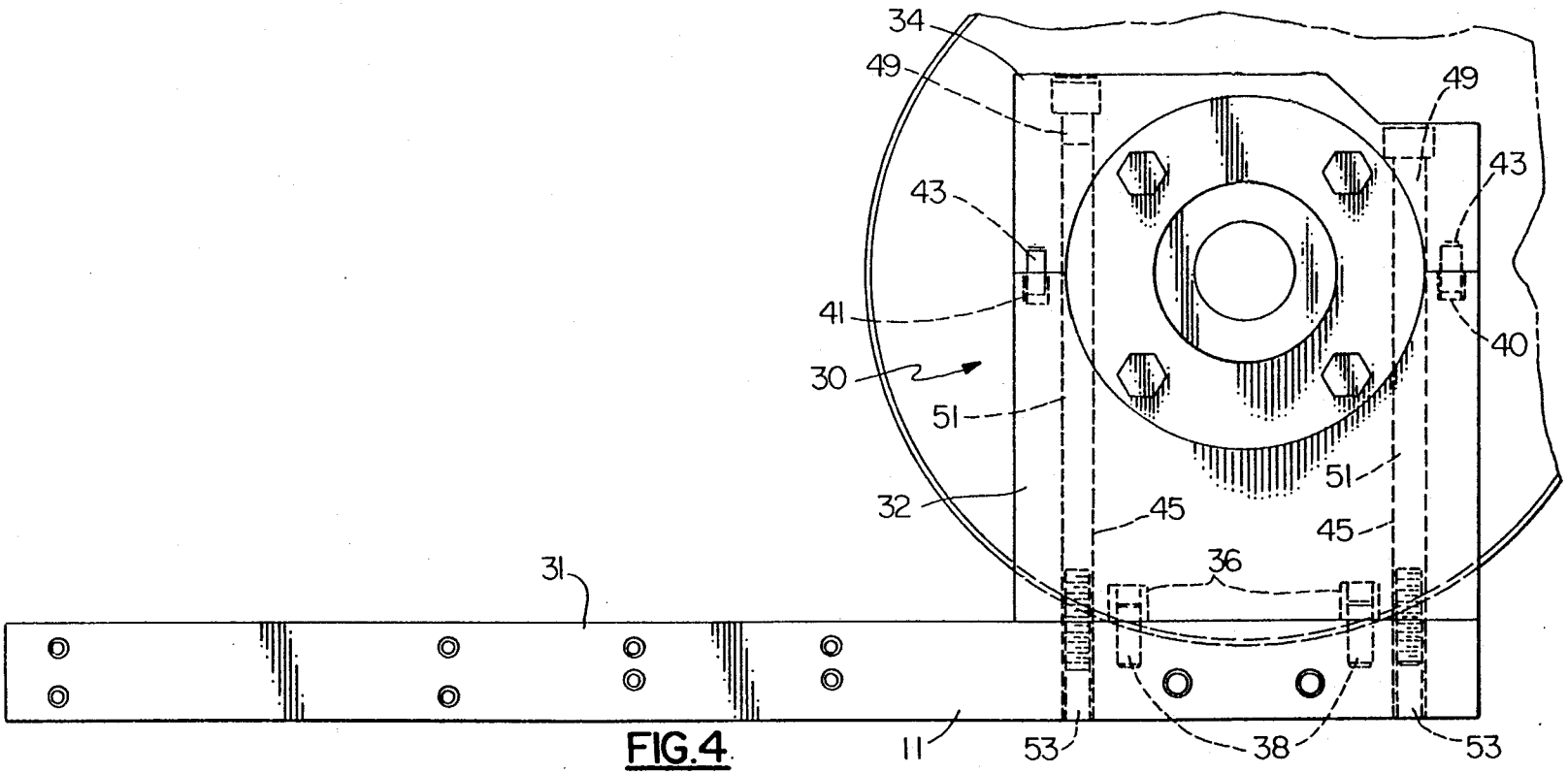
FIG. 4 is a side elevation the roll and block shown in FIG. 3.
Figure 5:
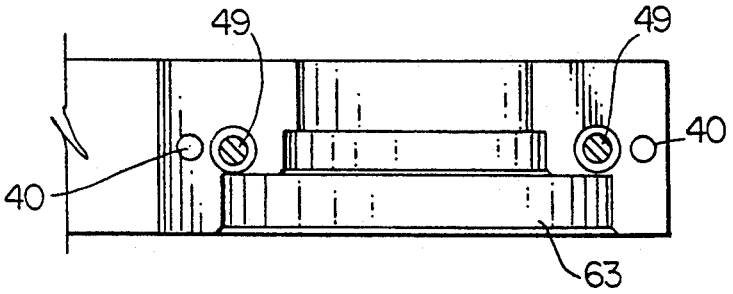
FIG. 5 is a sectional view of FIG. 4 taken through line 5—5.
Figure 6:
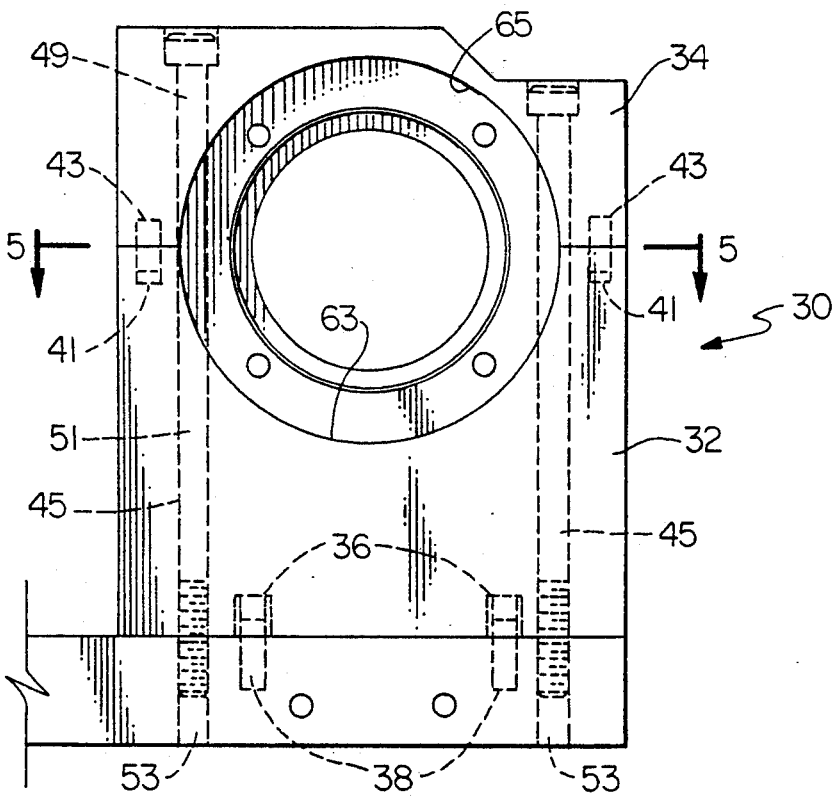
FIG. 6 is another side elevational view of the FIG. 3.
Figure 7:
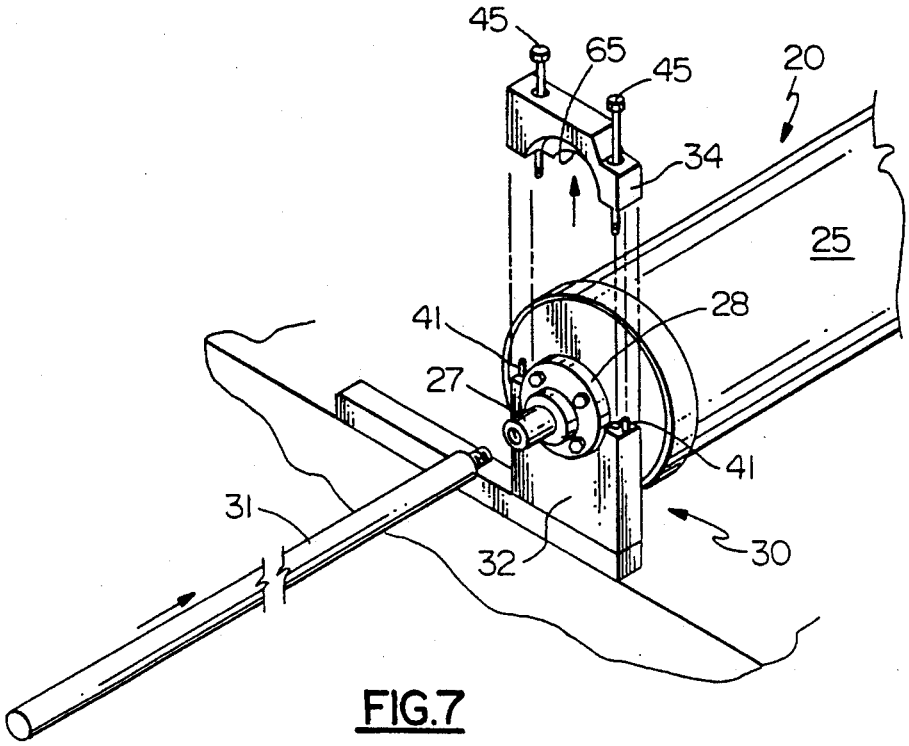

Turning now to the drawings, and in particular to FIG. 1, there is shown a typical flexographic printing press 10 that is suitable for use with the present invention. A web material 12 is printed by a printing roller 20, (seen in more detail in FIGS. 2 and 7) which cooperates with an impression roller 22 and an ink transfer roller 24. A removable printing sleeve 25 overlies printing roller 20. Linear adjustments 71, 72 are provided to accommodate printing rollers of different sizes and to vary the printing impression.

Printing roller 20 has an integral coaxial shaft or mandrel 27, the mandrel rotating on bearing assemblies, one of which is shown at reference numeral 28. The other end of printing roller 20 is a mirror image of the portion shown in FIG. 7. One end of mandrel 27 is adapted to receive a detachable axial extension 31. The bearing assembly 28 is axially fixed near each end of shaft 27. It is an aspect of the invention that bearing assembly 28, which may be of any suitable type, never need be shifted or removed once it has been mounted on shaft 27. The bearing assembly is preferably axially restrained by bearing collar 29, or it could be press fitted onto shaft 27, or held by a set screw.

A split bearing block 30 that holds bearing assembly 28 is seen in FIGS. 2, and 3–8, and a second bearing block 30' holds the bearing assembly 28' at the other end of printing roller 20. Bearing block 30 has a detachable upper section 34 and a lower section 32 which is mounted on frame 11 of the printing machine 10, slots or bores 36, 36 being provided on the bottom surface of block 30 for mating with locating pegs 38, 38 projecting upward from frame 11. Bearing block 30 is further secured to frame 11 by bolts 45, 45 which extend through bores 49,49 and 51,51 journaled through upper section 34 and lower section 32 respectively to threadably engage corresponding bores 53,53 in frame 11. Bearing block 30' may have a unitary construction, as it need not be disassembled. Bearing assembly 28' is a known self-aligning bearing, which can tolerate angular deviation which is imposed in accordance with the invention.

The combination of locating pins 41,41 and bores 43,43 respectively disposed on lower section 32 and upper section 34 serve to maintain the two sections of bearing block 30 in alignment until bolts 45,45 are installed.

The opposing surfaces 63, 65 of upper section 34 and lower section 32 (see FIGS. 5, 7) each conform to the geometry of bearing assembly 28, so that the bearing assembly seats on the mating surfaces and can be firmly held therebetween when bearing block 30 is assembled and bolts 45,45 are tightened.

To use the preferred embodiment of the invention printing roller 20 is provided with bearing assemblies 28, 28' as discussed above, and fitted with printing sleeve 25 in a known manner. For each end of roll 20 The lower sections 32 of bearing block 30 are positioned on frame 11, locating pegs 38,38 inserting into bores 36,36. Printing roller 20 is then positioned so that bearing assemblies 28 seat on surface 63 of lower section 32. Upper section 34 is mated with lower section 32 with the aid of locating pins 41,41 which insert into bores 43,43. Bolts 45 are slipped through bores 49,49 and 51,51, the two sets of bores being in registration. The bolts threadably engage bores 47,45 of frame 11, and are tightened so that bearing assembly 28 is firmly held within the assembled bearing block 30. Printing roller 20 can now revolve on the bearings within assembly 28, while being held in position. The printing roller 20 is now ready for operation when the printing press 10 is actuated.

Figure 8:
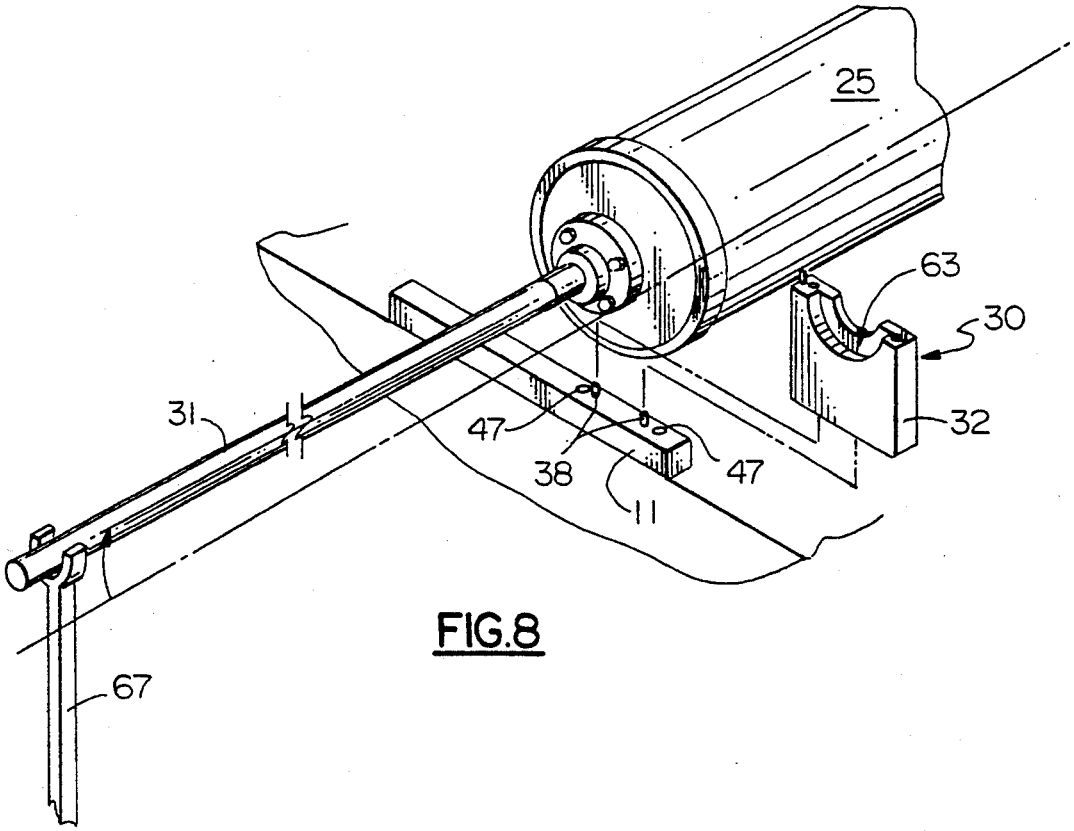

When it is desired to change the printing sleeve, the printing machine 10 is first stopped. Bolts 45,45 of bearing block 30 are loosened and withdrawn, and upper section 34 is detached. Once upper section 34 has been detached, bearing assembly 28 is released from bearing block 30 for movement in an upward direction that is substantially transverse to the axis of printing roller 20. Axial extension 31 is attached to the free end of mandrel 27, which is proximate the bearing assembly 28. With the leverage provided by axial extension 31 the printing roller and bearing assembly 28 are lifted clear of the lower section 32 and axial extension 31 supported by brace 67, which must be positioned at a sufficient interval from the junction 66 of mandrel 27 with axial extension 31 to allow printing sleeve 25 to clear printing roller 20 when the sleeve is extracted. The printing roller can be raised by any suitable means, such as a jack, or hoist (not illustrated). It is preferable to remove lower section 32 from frame 31, as is shown in FIG. 8, to assure that printing sleeve 25 also clears frame 11, and to minimize the distance that printing roller 20 must be raised.

Figure 9:
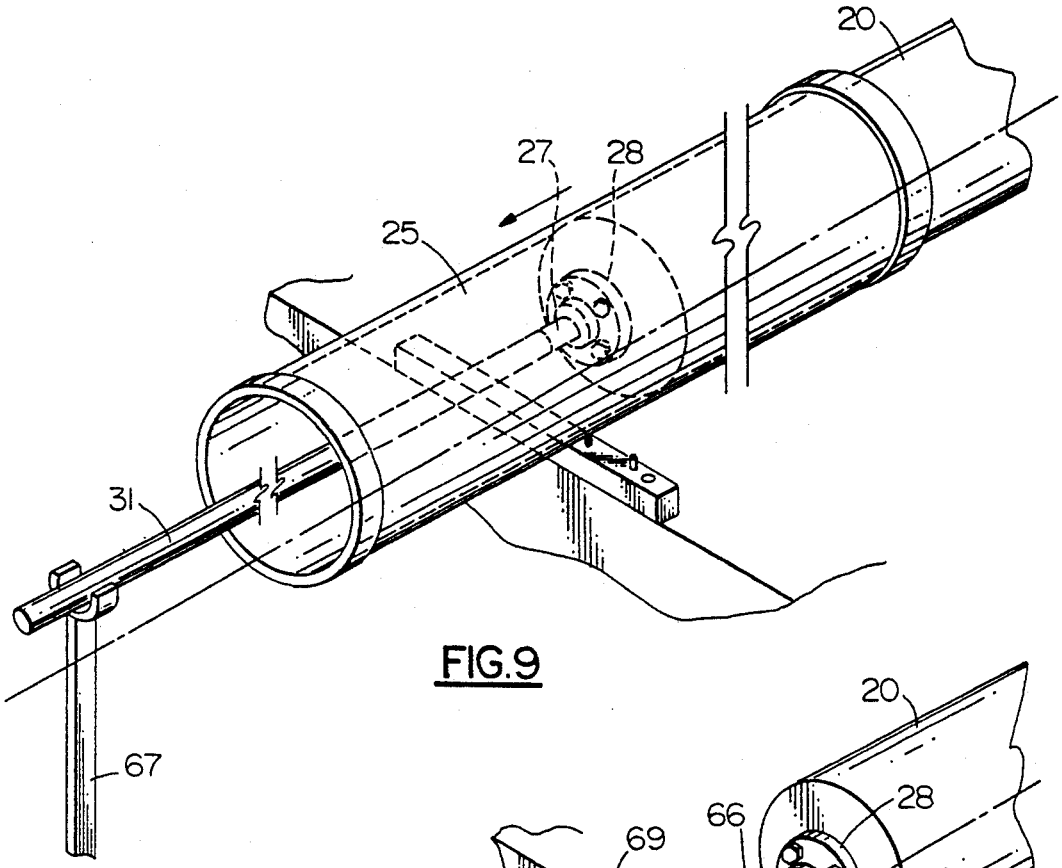
Figure 10:
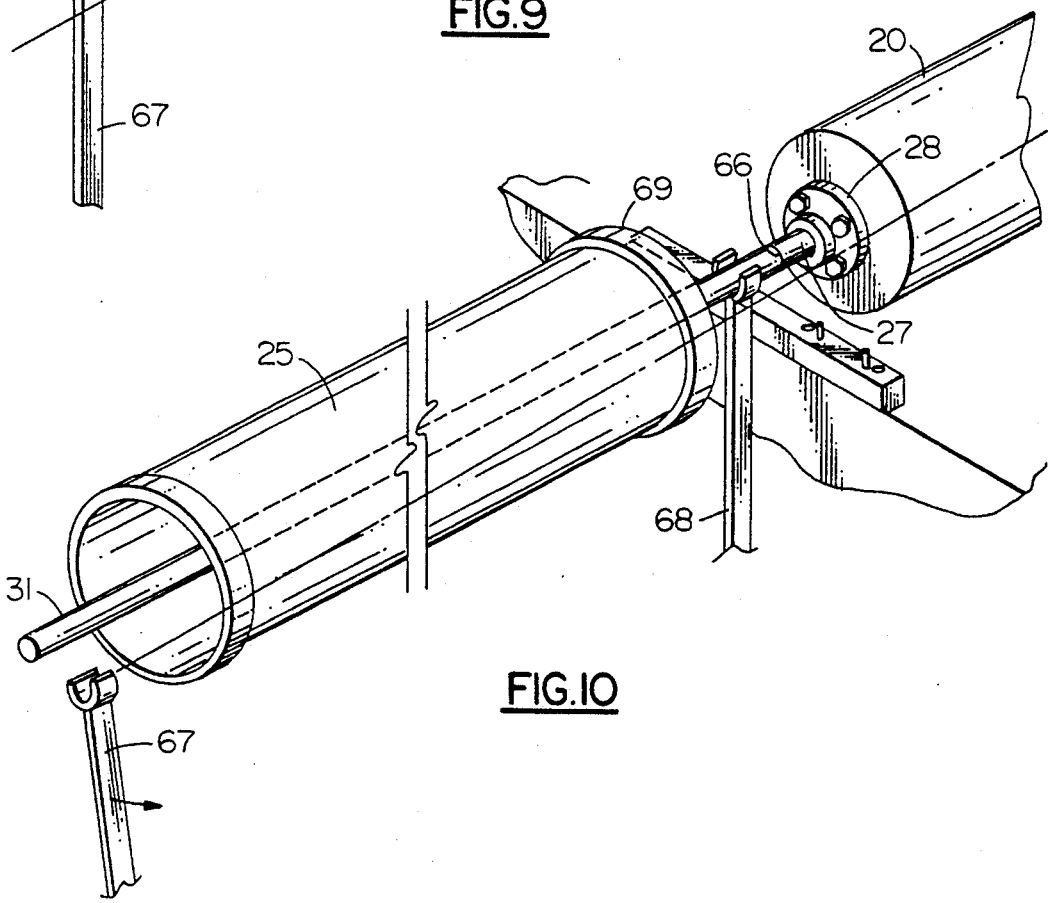

Referring now to FIGS. 9, 10, printing sleeve 25 is axially extracted from printing roller 20 along axial extension 31 until it clears printing roller 20. A second support brace 68 is placed under axial extension 31 intermediate the end 69 of extracted printing sleeve 25 and printing roller 20. Brace 67 is now withdrawn, allowing printing sleeve 25 to be entirely removed from axial extension 31.

To install a replacement printing sleeve, it is only necessary to reverse the foregoing steps. A replacement printing sleeve is moved over axial extension 31. Brace 67 is replaced in its original position, and brace 68 is withdrawn. The replacement printing sleeve is axially moved onto the printing roller 20. The lower section 32 of bearing block 30 is replaced on frame 11. Brace 67 is withdrawn, and printing roller 20 lowered to reseat bearing assembly 28 in surface 63 of lower section 32. Bearing blocks 30 is then fully reassembled as described hereinabove.

While this invention has been explained with reference to the structure disclosed herein, it is not confined to the details set forth and this application is intended to cover any modifications and changes as may come within the scope of the following claims:

What is claimed is:

1. A method of changing a removable sleeve on a printing roller of a printing machine, comprising the steps of:

mounting a bearing assembly that is fixedly disposed on a coaxial shaft of a printing roller in a bearing block, said printing roller having a radius, and a removable printing sleeve disposed thereon;

opening said bearing block to release said bearing assembly and said shaft therefrom;

pivoting said roller away from said opened bearing block, to provide a clearance for said printing sleeve;

supporting said pivoted roller at only one point in said machine and at a second point outside said machine;

axially removing said printing sleeve from said pivoted roller while performing said step of supporting.

2. The method of claim 1, further comprising the steps of:

installing a replacement printing sleeve on said printing roller by passing said replacement sleeve over said pivoted roller; and pivotally replacing said released bearing assembly in said bearing block.

3. The method of claim 1, wherein said steps of pivoting, supporting, and axially removing are performed by the steps of:

attaching an axial extension to said coaxial shaft and pivoting said roller in a generally upward direction therewith about said only one point;

then supporting said attached axial extension at a first location thereon that is at an interval from said printing roller sufficient to allow said printing sleeve to clear said printing roller;

axially extracting said printing sleeve along said supported attached axial extension;

supporting one of said attached axial extension and said coaxial shaft at a second location that is intermediate said printing roller and said extracted printing sleeve;

thereafter withdrawing support from said attached axial extension at said first location; and removing said extracted printing sleeve.

4. The method of claim 3, wherein said bearing assembly is transfered through said printing sleeve during said step of axially extracting.

5. The method of claim 3, further comprising the steps of:

after said step of removing has been performed, disposing a replacement printing sleeve around said attached axial extension;

renewing support for said attached axial extension at said first location;

thereafter withdrawing support for said attached axial extension at said second location; and axially moving said replacement printing sleeve onto said printing roller.

6. A printing machine of the type having a demountable printing roller having a removable printing sleeve thereon, comprising:

a printing roller, having a bearing assembly disposed on a coaxial shaft thereof, and having a radius, and a longitudinal axis;

block means for mounting said roller, said block means holding said bearing assembly therein and being openable to permit said shaft to be pivotally released therefrom;

an extension, attachable to said shaft for pivoting therewith, said printing sleeve being transferable over said attached extension and being in non-contacting relationship therewith;

support means disposed outside said machine in non-contacting relationship with said printing sleeve for supporting said extension and said pivoted shaft, said pivoted shaft being supported in said machine at only one pivotal point; and whereby said printing sleeve can be exchanged with another printing sleeve.

7. The machine of claim 6, wherein said bearing assembly is axially fixed on said coaxial shaft, whereby said bearing assembly is transferred through said printing sleeve when said sleeve is removed from said printing roller.

8. The printing machine of claim 6 wherein said block means comprises:

a first section, attached to said printing machine; a second section, detachable from said first section and from said printing machine; and means for releasably holding said first and said second sections together in engagement with said bearing assembly therebetween.

9. The printing machine of claim 8, wherein said means for holding comprises:

a bolt, disposed in bores journaled in registration through said first and second sections;

whereby when said bolt is removed, said bearing assembly is released from said block.

10. In combination, a printing machine of the type employing a removable printing sleeve and a printing roller carrying the printing sleeve, said printing roller having a radius and being revolvable on a bearing assembly;

said yoke being changeable from an operating position that encloses said bearing assembly to an open position that permits said bearing assembly and said printing roller to be pivotally displaced from said yoke while said bearing assembly and said printing roller are in a contact relationship;

a detachable extension, adapted to connect with a mandrel of said printing roller and being in non-contacting relationship with said sleeve;

first and second means disposed external to said machine in non-contacting relationship with said sleeve for alternately supporting said mandrel and said extension at respective first and second locations, said sleeve being axially passable over said extension while said mandrel and said extension are being alternately supported by said first and second means, said roller being supported in said machine at only one pivotal point;

whereby said printing sleeve can be replaced without removing said bearing from said printing roller while said printing roller remains attached to said printing machine.

11. The printing machine of claim 10, further comprising means for retaining said yoke in said operating position.

12. The printing machine of claim 11, wherein said means for retaining comprises a bolt, threadably engaged in said frame.

* * * * *

UNITED STATES PATENT AND TRADEMARK OFFICE

CERTIFICATE OF CORRECTION

PATENT NO. : 5,289,769

DATED : March 1, 1994

INVENTOR(S) : Robert J. Lewis

It is certified that error appears in the above—identified patent and that said Letters Patent is hereby corrected as shown below:

Col. 6, after line 14, insert new paragraph —a split yoke disposed on a frame of said machine and having said bearing assembly seated therein;--

Signed and Sealed this

Twenty-sixth Day of July, 1994

Bruce Lehman

*Attest:*

BRUCE LEHMAN

*Attesting Officer*

*Commissioner of Patents and Trademarks*